US005279016A

United States Patent [19]

Klassen

[11] Patent Number: 5,279,016

[45] Date of Patent: Jan. 18, 1994

[54] VACUUM OUTLET FOR BUILT IN VACUUM

[76] Inventor: Timothy J. Klassen, 286 Stuart Avenue, Winnipeg, Manitoba, Canada, R2G 0Y8

[21] Appl. No.: 920,910

[22] Filed: Jul. 28, 1992

[51] Int. Cl.[5] ..... A47L 5/38

[52] U.S. Cl. ..... 15/301; 15/339; 15/412

[58] Field of Search ..... 15/301, 310, 314, 339, 15/412

[56] References Cited

U.S. PATENT DOCUMENTS

| | | | |
|---|---|---|---|
| 2,599,049 | 6/1952 | Dollinger | 15/301 |
| 2,979,755 | 4/1961 | McCaskill | 15/301 |
| 3,027,587 | 4/1962 | Bierstock | 15/301 |
| 3,027,588 | 4/1962 | Bierstock | 15/301 |
| 3,353,996 | 11/1967 | Hamrick | 15/301 |
| 3,568,240 | 3/1971 | Hamrick | 15/314 |

*Primary Examiner*—Philip R. Coe
*Assistant Examiner*—Reginald L. Alexander
*Attorney, Agent, or Firm*—Adrian D. Battison; Stanley G. Ade; Murray E. Thrift

[57] ABSTRACT

A suction inlet for a central vacuum system of a building includes a housing mounted on the floor of the building and defining a slot along the floor. The slot can be opened and closed and simultaneously a vacuum duct connected to the housing is opened and closed by a plug member. When the plug and the slot are opened, a switch actuates the central vacuum system to draw air into the housing through the slot across the floor so that dust, dirt and debris on the floor can simply be swept into the slot and drawn away.

8 Claims, 4 Drawing Sheets

VACUUM OUTLET FOR BUILT IN VACUUM

BACKGROUND OF THE INVENTION

This invention relates to an air inlet for a central vacuum system within a building.

Central vacuum systems have become more popular in recent years due to the convenience of use and the high air flow which can be generated using the larger fan systems possible when the vacuum source is a fixed source at a central location within the building.

As far is known, the only inlet arrangements which are used for such central vacuums comprise a wall mounted opening to which can be attached a hose so that the user can move the inlet end of the hose around the building while the outlet end of the hose is attached to the wall mounting. Generally such wall mountings including a flap on the outside surface which can be closed against a suitable seal to prevent air entry through that inlet when the inlet is not in use. When the flap valve is open, this exposes a cylindrical channel into which an end of the hose can be inserted. The cylindrical channel includes a rubber O ring to seal around the end of the hose. The hose actuates a switch simply by shorting across two connectors so as to actuate the central vacuum source when the hose is in place.

It is necessary with all of these vacuum inlet connectors to provide a hose and therefore to transport the hose around the house or building even for relatively small clean-up jobs, for example picking up crumbs or other spills in the kitchen or dining room area. Often the kitchen and dining room area have floors which are not carpeted but covered by a smooth hard material such as tile, vinyl or wood. To clean up such minor spills, therefore, the householder often prefers to use a dust pan and brush rather than get out the hose and connect it to the vacuum inlet.

It is one object of the present invention to provide an improved vacuum inlet for a central vacuum system in a building which is more effective and advantageous for use with a smooth, non-carpeted floor area.

According to the invention, therefore, there is provided an inlet for a central vacuum system within a building, comprising a building floor, a central vacuum source, a vacuum inlet housing mounted in the floor, vacuum connection means on the housing connected to said central vacuum source for drawing air into the housing for transportation of dust and dirt, means on the housing defining an elongated slot with one side edge of the slow lying along the floor such that material swept along the floor can enter this slot to be entrained with air drawn into the housing through the slot, valve means for closing off air flow through the housing to said central source from said slot and switch means responsive to opening of said valve means for actuating said central source.

Embodiments of the invention will now be described in conjunction with the accompanying drawings in which:

DESCRIPTION OF THE DRAWINGS

In the drawings like characters of reference indicate corresponding parts in the different figures.

DETAILED DESCRIPTION

Figure 1:
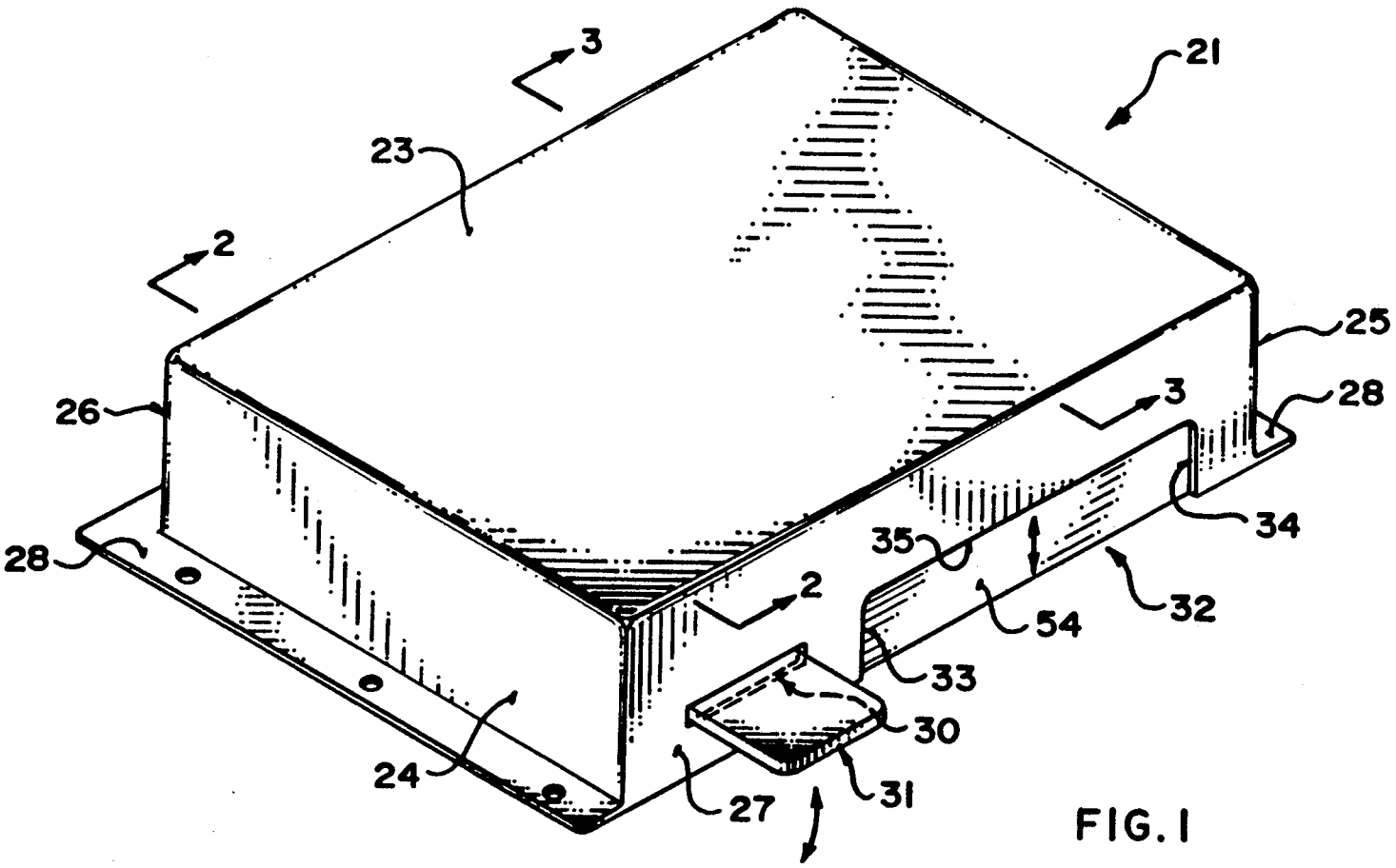
FIG. 1 is an isometric view of the housing section of an inlet for a central vacuum system according to the present invention.
Figure 2:
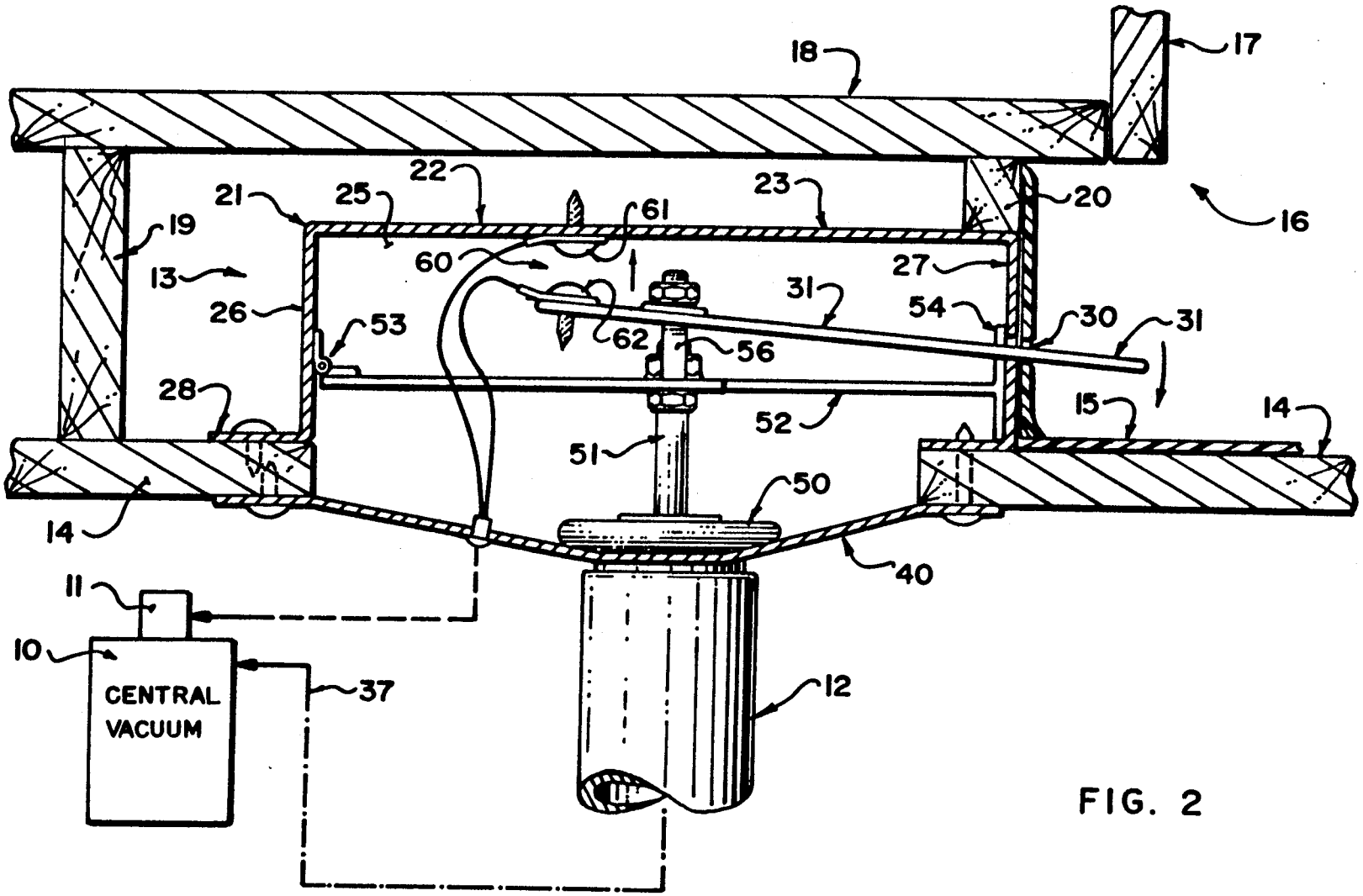
FIG. 2 is a cross sectional view along the lines 2—2 of FIG. 1 showing the housing installed on a floor and beneath a cabinet.

The inlet in FIGS. 1, 2 an 3 forms part of a central vacuum system including a central vacuum suction member 10 of conventional nature which is shown only schematically and is operated by a switch on a motor arrangement 11 for driving the fan which draws air into the central vacuum system for extraction of the dust and dirt carried through the ducts of the central vacuum system to the central container. One duct is illustrated at 12 and is connected to an inlet generally indicated at 13 through which the vacuum can be drawn to pull air into the inlet for transporting the dust, dirt and other debris away from the inlet.

The inlet is mounted in a building such as a family home and of the building only the floor is shown as indicated at 14 which includes a sub-floor together with a covering layer 15 for example of tile or vinyl for use particularly but not exclusively in a kitchen or similar area. A cabinet 16 includes a cabinet front wall 17 and a cabinet base 18 positioned above the floor 14 and supported therefrom on suitable supports 19. Along a front edge of the cabinet recessed from the front wall 17 between the floor and the cabinet is provided a kick plate 20 of conventional construction.

The inlet 13 comprises a housing 21 including an upper housing part 22 and a lower housing part 40 which are formed in the embodiment as shown as two separate elements but could in another arrangement be formed as an integral unit. The uppoer housing part 22 is generally rectangular and is shown in FIG. 1 including a top wall 23, two side walls 24 and 25, a rear wall 26 and a front wall 27. The walls are substantially fully closed so as to form a hollow rectangular container. Flanges 28 extend outwardly from the side walls 24 and 25 and the rear wall 26 at right angles so as to allow the upper housing part 22 to be screwed to the upper surface of the floor 14. The front face 27 includes a first slot shaped opening 30 adjacent the side wall 24 through which projects a lever 31 which can be actuated by foot pressure downwardly on a portion of the lever projecting outwardly through the slot 30 so as to cause the lever 31 to pivot about a fulcrum defined by the lower edge of the slot 30.

A remaining part of the front face 27 includes a larger slot shaped opening 32 which extends down to the floor surface 15. Thus the slot shaped opening 32 is defined by vertical side edges 33 and 34, a top edge 35 and by the upper surface of the floor.

The bottom portion of the housing is indicated at 40 and comprises a dished lower pan surface converging downwardly to an outlet opening 41 which is circular for connection to the duct 12. Thus actuation of the suction at the central vacuum source 10 will cause air to be drawn into the duct 12 through the opening 41 at the base of the lower housing portion with the air being drawn into the housing through the slot 32 across the floor surface. With the slot open therefore material dropped on the floor can simply be swept to a position adjacent the slot where it is drawn into the slot and carried away. There is no need therefore for hoses or the like and a simple sweeping brush or pushing action on the dirt, dust or other debris will allow it to be carried away into the housing.

Figure 3:
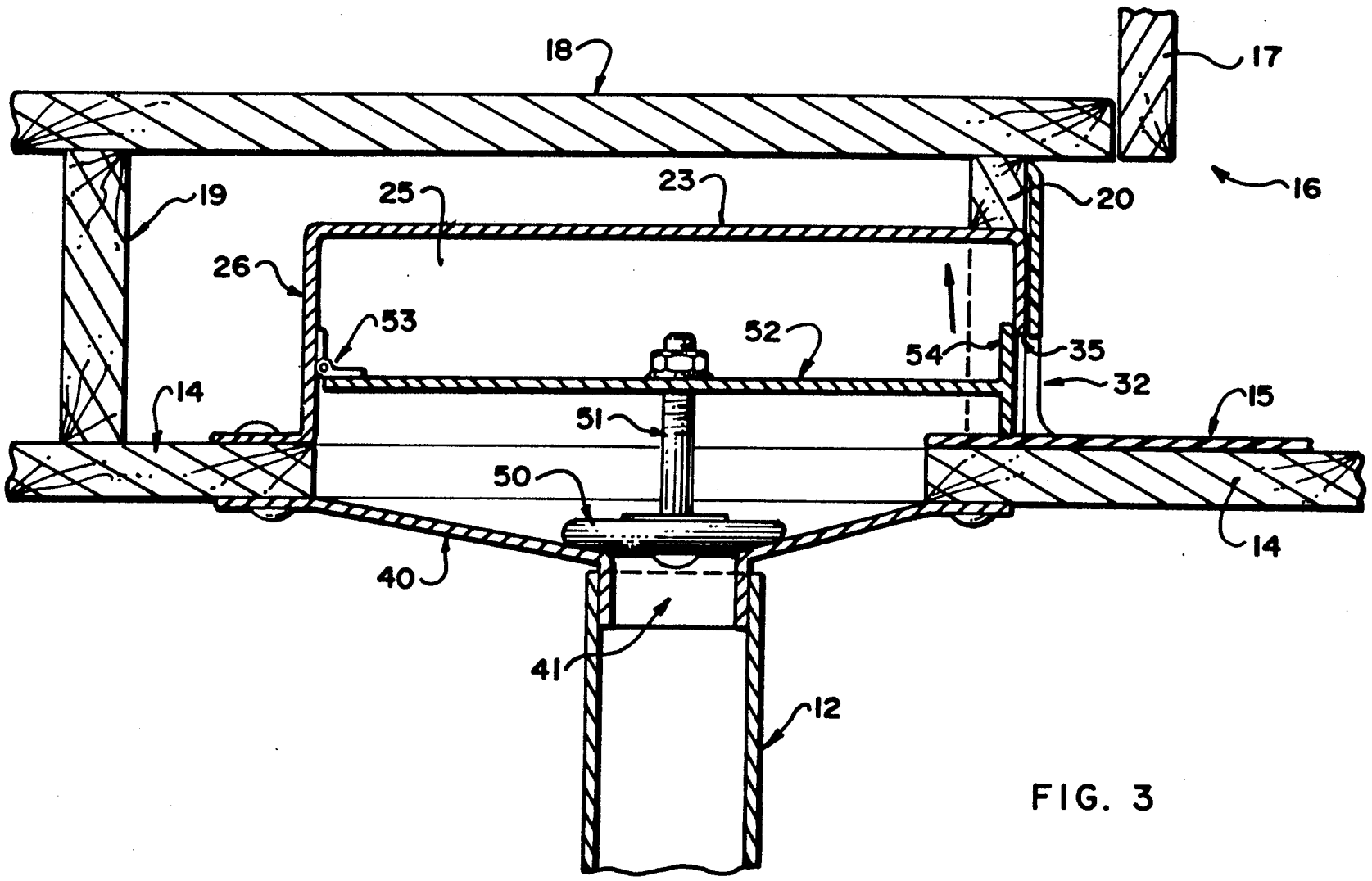
FIG. 3 is a cross sectional view along the lines 3—3 of FIG. 1.

In order to control the actuation of the suction 37, there is provided a plug member 50 which can close the opening 41. The plug comprises a flat rubber disk which is placed on top of the opening 41 by the application of suction. The flat rubber disk is carried upon a post 51 which in turn is mounted on a plate 52 hinged to the back wall 26 by a hinge coupling 53. At the front edge of the plate 52 is provided a vertical door plate 54 which lies on the inside surface of the front wall 27 and has a height as shown in FIG. 3 just greater than the slot 32 so that when lowered the plate 54 fully closes the slot as shown in Fig. 1. The plate can however be lifted vertically by upward movement of the horizontal plate 52 about the hinge 53. The plate 52 also carries the pin 51 which lifts the plug 50 away from the opening 41. The movement of the plate 52 is actuated by the lever 31 and these are connected together by a vertical connector 56. At the outer end of the lever 31 spaced from the fulcrum is provided an electrical switch 60 including an upper contact 61 attached to the top wall 23 and a lower contact 62 attached to the outer end of the lever 31. The switch contacts form part of a low voltage control system for the central vacuum.

In operation, therefore, the weight of the plate and the lever normally hold the plug 50 in the lower closed position so that when any other inlet to the central vacuum system is opened and actuated the plug prevents air from being drawn into the duct 12.

When the operator wishes to open the slot to receive dust and the like, the operator simply places a foot on the outer end of the lever 31 pressing this downwardly. This action therefore lifts the plate 52 moving the plug 50 upwardly and opening the slot by sliding the plate 54. At the end of the stroke of the movement of the lever the switch contacts close actuating the central vacuum and causing the air to flow through the open slot and under the opened plug to the duct 12.

Figure 4:
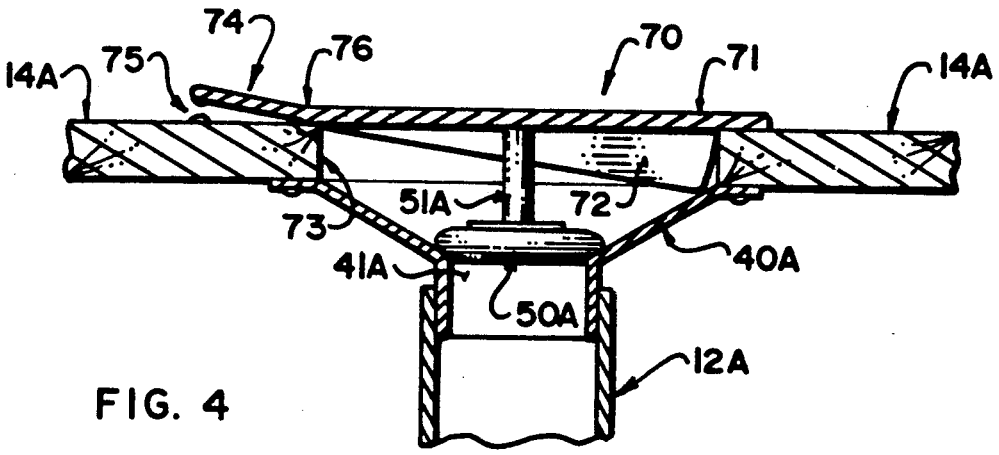
FIG. 4 is a cross sectional view through a second embodiment of inlet according to the present invention.
Figure 5:
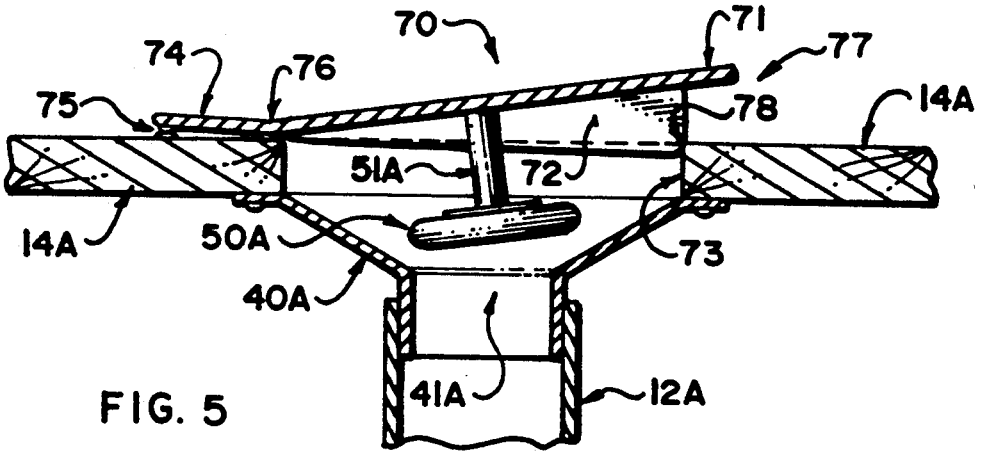
FIG. 5 is a similar cross sectional view showing the inlet in the open position.
Figure 6:
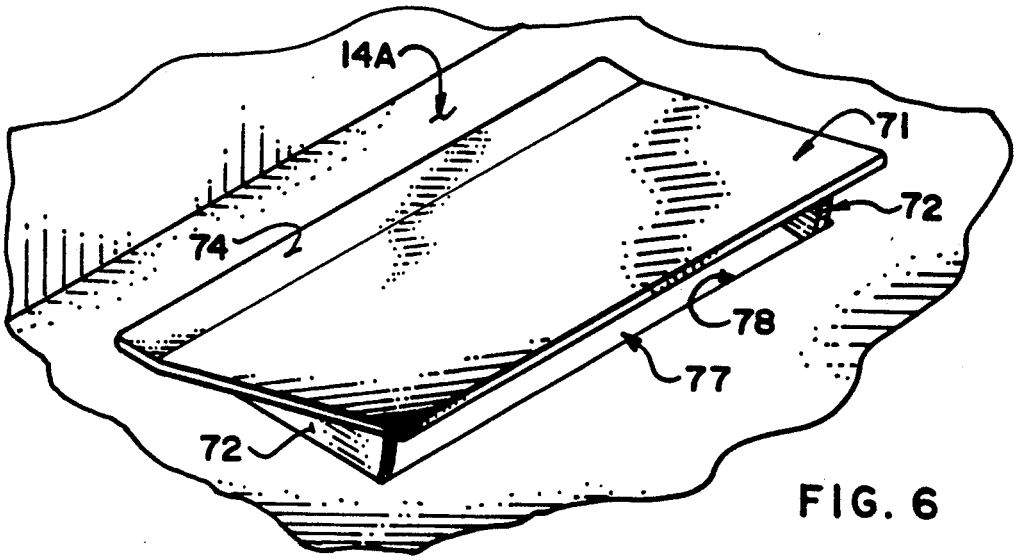
FIG. 6 is an isometric view of the inlet of FIGS. 4 and 5.

Turning now to FIGS. 4, 5 and 6, there is shown an alternative arrangement of a similar nature including a duct 12A and an inlet construction 70 provided in a floor 14A of a building. In this case the inlet housing 70 is positioned directly in the floor rather than in the kick space at the base of the cabinet. The housing includes a lower portion 40A similar to the lower portion previously described and plug 50A mounted on a pin 51A for vertical movement away from the opening 41A in the base of the housing portion 40A. In this case the upper part of the housing simply comprises a flat plate 71 with sides 72 which project into a rectangular opening 73 in the floor. At the back of the flat plate 71 is provided an angle plate 74 with switch contacts 75 at a rear edge of the angle plate 74. In the closed position shown in FIG. 4, the angle plate 74 is inclined upwardly and rearwardly from a fulcrum 76 at a rear edge of the plate 71. The fulcrum 76 lies along the rear edge of the opening 73. Thus when the operator presses downwardly on the angle plate 74, this causes the flat plate 71 to be lifted upwardly away from the floor surface at the front edge thus defining a slot 77 between the underside of the plate 71 and the upper surface of the floor as best shown in FIG. 6. The sides of the slot are closed by the side plates 72 so that the slot is provided only at a front edge 78 of the opening 73 and the floor. The plug 50A is carried on the underside of the plate 71 so that the movement of the plate lifts the plug away from the opening 41A. Again, the completion of the stroke of movement of the plate actuates the switch 75 to commence the suction action. Release of the angle plate allows the slot to close under gravity or spring return if required.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An inlet for a central vacuum system within a building, comprising a building floor, a central vacuum source, a vacuum inlet housing mounted at the floor and fixed relative to the floor, vacuum connection means on the housing connected to said central vacuum source for drawing air into the housing for transportation of dust and dirt therefrom, slot means on the housing for defining an elongated slot with one side edge of the slot lying substantially along the floor such that material swept along the floor can enter the slot to be entrained with air drawn into the housing through the slot, the housing being closed apart from said vacuum connection means and said slot means such that actuation of said vacuum source causes an air flow along a path through said slot into said housing and from said housing through said vacuum connection means, sealing means in said path having a first sealing position for sealing off air flow through the housing along said path to said central source from said slot and a second open position allowing air flow along said path, the sealing means being biased to said first sealing position, lever means actuable by pressure from a foot of a user for moving said sealing means from the first sealing position to the second open position and switch means responsive to movement of said sealing means by said lever means from said first sealing position to said second open position for actuating said central source.

2. The inlet according to claim 1 wherein the housing includes a wall upstanding from the floor, said means defining said slot being arranged at a bottom part of the front face.

3. The inlet according to claim 2 wherein the sealing means includes a closure member movable relative to said front face for closing the slot.

4. The inlet according to claim 3 wherein the closure member moves upwardly along the front face.

5. The inlet according to claim 1 wherein the sealing means includes a plug member mounted within the housing and movable relative thereto to close a cylindrical outlet of the housing forming part of said vacuum connection means.

6. The inlet according to claim 1 wherein the housing comprises a substantially rectangular housing having a planar front face, the slot being formed at the bottom of the front face, the housing being positioned on top of the floor and extending upwardly therefrom, the housing including a base portion positioned under the floor, the base portion having a circular outlet therein defining an opening to said vacuum connection means, said valve member comprising a circular plug member moveable from a first position engaging said opening in a vertically upward direction away from said opening to allow air to enter said opening, a foot actuable lever being positioned on said housing and projecting outwardly from said front face, said lever being operable to lift the plug member to the open position, said switch means including a portion thereof mounted on said lever member such an upward movement of the lever member on the plug to a fully open position causes closing of the switch means to actuate said central source, and a plate member moveable by said lever in a vertical direction along an inside surface of the front face for opening and closing the slot.

7. The inlet according to claim 1 including a flap member moveable from a first position flush with the floor thus closing the slot to an open position in which an edge of the flap member is moved away from the floor to define the slot between the edge of the flap member and the floor, the flap member acting to direct air from the slot downwardly through the, floor into said housing.

8. The inlet according to claim 7 wherein the valve means includes a plug member carried by the flap member and moveable therewith from a closed position closing an outlet opening of the housing when the flap member is in the first position to an open position when the flap member is raised and defining said slot.

* * * * *